United States Patent [19]

Glodek

[11] 3,951,315

[45] Apr. 20, 1976

[54] FUEL PUMP NOZZLE ANTI DRIBBLE DEVICE

[76] Inventor: Thomas R. Glodek, 4572 Via Marina, Apt. 201, Marina del Rey, Calif. 90291

[22] Filed: Aug. 22, 1974

[21] Appl. No.: 499,396

[52] U.S. Cl. ..... 222/491; 222/517; 222/556; 222/571

[51] Int. Cl.[2] ..... B65D 47/08

[58] Field of Search ..... 222/491, 517, 529, 545, 222/556, 571, 567

[56] References Cited

UNITED STATES PATENTS

| | | | |
|---|---|---|---|
| 1,390,508 | 9/1921 | Crowder | 222/545 X |
| 1,503,187 | 7/1924 | Fitchett | 222/517 X |
| 1,913,811 | 6/1933 | Laufe | 222/491 X |
| 2,780,396 | 2/1957 | Larrabee | 222/556 X |
| 3,120,879 | 2/1964 | Warner | 222/517 X |
| 3,163,331 | 12/1964 | Wallberg | 222/556 X |
| 3,406,695 | 10/1968 | Perl | 222/491 X |

FOREIGN PATENTS OR APPLICATIONS

| | | | |
|---|---|---|---|
| 604,646 | 7/1948 | United Kingdom | 222/556 |

*Primary Examiner*—Robert B. Reeves
*Assistant Examiner*—Frederick R. Handren
*Attorney, Agent, or Firm*—Blakely, Sokoloff, Taylor & Zafman

[57] ABSTRACT

A fuel pump nozzle anti-dribble device for mounting to the end of the nozzle on a conventional fuel delivery pump, such as a gasoline pump to eliminate dripping and spillage of fuel therefrom upon withdrawal of the nozzle from a vehicle fuel tank. The anti dribble device has a flap which is lightly spring loaded to the closed position to close off the flow area of the nozzle upon the shutting off of the nozzle. The flap is spring loaded so as to allow movement to an open position upon the turning on of the nozzle without tripping the automatic shut-off device normally found on such nozzles.

9 Claims, 9 Drawing Figures

22
20
2
34
36
32
44
40
38
26
24
2

32

36
44
32
24
3
34
40
22
38
3
30
28
26
47
45
52
53

48
22
20
50
26

38
32
42
40
42
24

20
46
48
26
22
50

42
62
64
62
42
24
32a
32a 22
20
46
26
48
50

60
32a
32a

FUEL PUMP NOZZLE ANTI DRIBBLE DEVICE

BACKGROUND OF THE INVENTION

1. Field of the Invention

The present invention relates to the field of fluid delivery systems, and particularly through conventional fuel pumps for delivering fuel to individual vehicles.

2. Prior Art

In the use of gasoline pumps in automobile filling stations, some increment of dispensed fuel frequently drips out of or is poured from the opening of the pump nozzle when the pumping action is completed. The principle cause for this occurrence is that fuel not contained beyond the automatic valve closure remains in the nozzle. Another factor which contributes to an increment of fuel being trapped within the nozzle occurs when the fuel in the receptacle overflows and backs up into the nozzle. Thus, when the nozzle is extracted from the receptacle the trapped fuel inside the nozzle drips out of or is spilled from the nozzle. While the amount of fuel lost in any single delivery is normally relatively small, on occasion a substantial amount of fuel may be lost if the nozzle is substantially full when withdrawn from the receptacle, and even small losses accumulate because of the great amounts of fuel handled, so that the total amount wasted in the United States over a period of one year is very large.

At the present time, conventional delivery nozzles have a shut off valve in the hand unit separated from the ultimate nozzle delivery point by a tubular member of substantial length and diameter, whereby substantial amounts of fuel may be confined within the tubular member between the end thereof and the shut off valve. There is now no anti dribble device in common usage for such pumps, whether such pumps are delivering gasoline or other fuels to any type of vehicles, such as cars, trucks, boats and airplanes, to name a few.

BRIEF SUMMARY OF THE INVENTION

The present invention is a fuel pump nozzle anti dribble device to eliminate the dripping and spillage from the nozzle upon withdrawal from the receptacle (fuel tank). A plastic tubular body is provided for pressing over the end of the nozzle, and having a flap at the other end thereof spring loaded to a closed position to seal off the undesired flow of fuel. Upon turning on the nozzle, the flap will readily move to the open position to allow the relatively unrestricted flow of fuel therefrom. Alternate embodiments, including a latching device are disclosed.

DETAILED DESCRIPTION OF THE INVENTION

Figures 1, 2, 2A, 3, 4, 4A, 5, 6, 7:
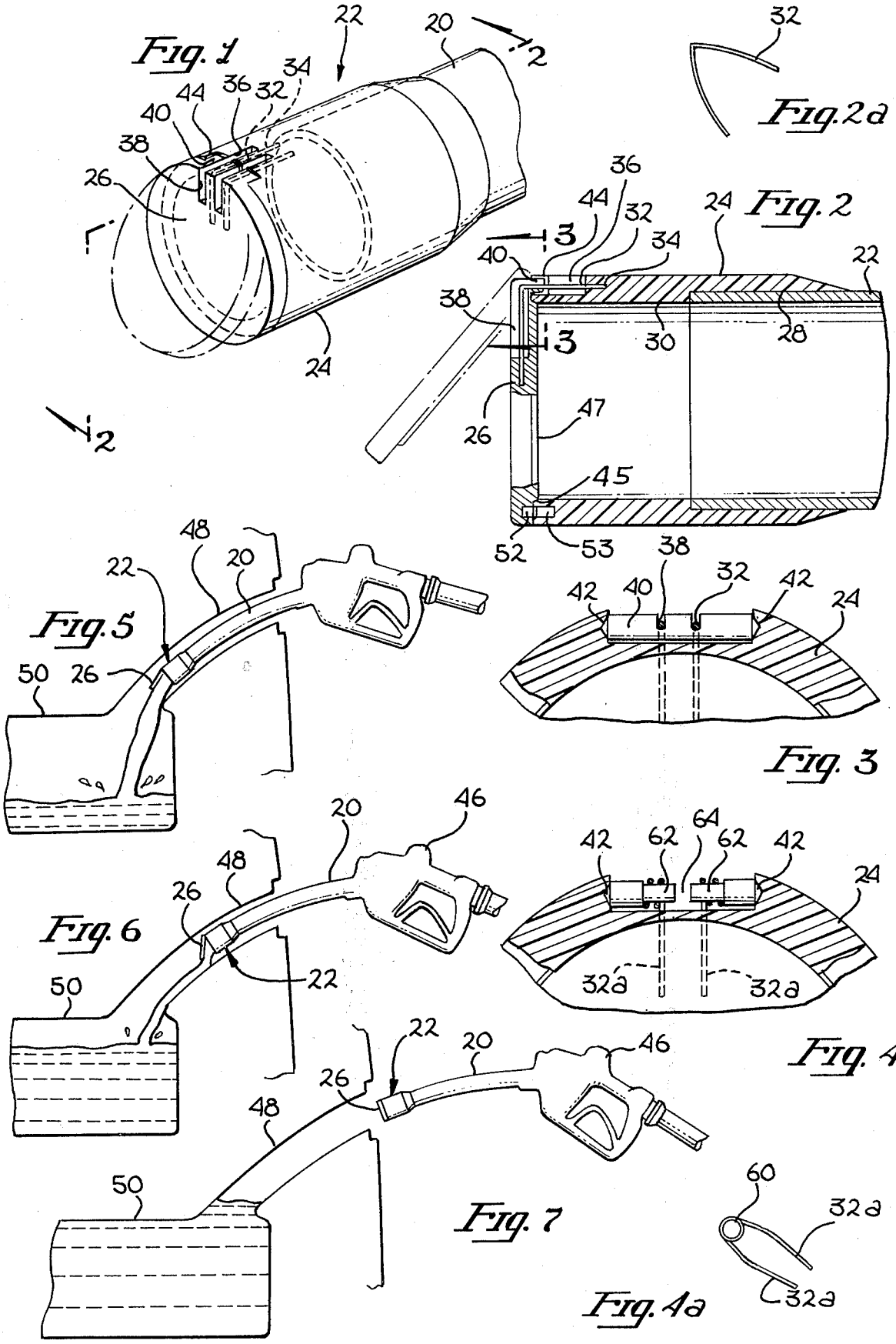
FIG. 1 is a perspective view of the present invention.
FIG. 2 is a cross section taken along line 2—2 of FIG. 1.
FIG. 2*a* is an illustration of the free form of spring 32.
FIG. 3 is a cross section taken along line 3—3 of FIG. 2.
FIG. 4 is a cross section of an alternate embodiment similar to the cross section of FIG. 3.
FIG. 4*a* is an illustration of the free form of spring 32*a*.
FIGS. 5, 6 and 7 are schemetics illustrating the function of the present invention.

First referring to FIG. 1, a perspective view of one embodiment of the present invention as it mounts on a conventional gasoline pump nozzle. The conventional gasoline pump nozzle is comprised of a tubular member having at least a substantial straight section 20 at the outermost end thereof. The present invention anti dribble device, generally indicated by the numeral 22, mounts thereover. The anti dribble device is characterized by a body 24, and an end flap 26 rotationally attached to the body 24 so as to move between a closed position, closing off the end of member 24, and an open position providing no substantial restriction to the flow of gasoline out through body member 24. In FIG. 1, the flap 26 is illustrated in phantom in a partially open condition, typically representing either one position in the movement between the open and closed positions, or a stable position for gasoline delivery at much less than maximum flow rate for a typical gas pump.

Now referring to FIG. 2, a cross section taken along line 2—2 of FIG. 1 may be seen. It may be seen that the body member 24 is a generally cylindrical member intended for pressing over the outer diameter of the tubular section 22 on the nozzle. Thus, member 24 has a first inner diameter 28 forming a press fit over member 22, with the inner diameter 30 of the remaining portion of member 24 having a reduced diameter, preferably equal to the inner diameter of member 22 and defining a transition between diameter 30 and diameter of surface 28 so as to define the extent of penetration of member 22 into member 24. At the outer end of member 24 is the flap 26, shown in the closed position and in phantom in a partially opened position. The flap 26 in the preferred embodiment is hinged at one side thereof to the periphery of member 24 in a manner which will subsequently be described in detail. A pair of springs 32, (also shown in phantom in FIG. 1) are disposed between body 24 and flap 26, so as to yieldably encourage the flap to the position shown in FIG. 2. One end of springs 32 are pressed in the mating holes 34 in body 24, with the other end being pressed into similar mating holes in flaps 26. The springs 32 may be simple spring wire members bent in the freeform to an angle of slightly less than 90 degrees, so that when encouraged to the position shown in FIG. 2, the spring members will provide a light closing pressure on flap 26 to encourage the flap to the closed position. In fact, springs 32 are preferably formed so as to have a free state profile shown in FIG. 2a, so as to be yieldably encouraged to the condition shown in FIG. 2 even when the flap is closed so as to provide encouragement to the closed position through the preload of the spring and to further not greatly increase the closing force when flap 26 moves to the open positions. In this regard, it is to be noted that the preload is for the purpose of preloading or bending the springs within their yield limits by a substantial amount, even in the closed position, so that the force caused by the springs does not greatly increase when the flap is in the open position. Without the preload, there would be no significant closing force in the closed position, though the closing force when in the open position would go up greatly.

In order to provide a satisfactory flexing length for springs 32, member 24 has slots 36 inward to the respective ends of springs 32 to allow for the free bending of the springs in that region. Similarly, flap 26 is slotted in region 38 to provide additional free length for springs 32 to accommodate the flexing thereof. This assures that the elastic limit of the springs will not be exceeded when the flap moves to the open position. Of course, the magnitude of the closing force on the flap 26 in this embodiment will be dependent upon the diameter of the spring wire used, which may be selected based upon the sensitivity of the automatic shut off mechanism of the delivery nozzle.

Now referring to FIG. 3, a cross section taken along line 3—3 of FIG. 2 may be seen. This cross section illustrates the hinging on the preferred embodiment for supporting and hinging flap 26 from member 24. The cross section, as taken, shows the surrounding region of member 24 in cross section, and springs 32 in cross section. Member 40, also shown in FIG. 2, is a local rearward extension of flap 26 characterized by pivot-like protrusions 42 extending into mating pockets in member 24 in the surfaces defining the lateral extremes of the relieved area 44 (see FIG. 2). Also illustrated in FIG. 3, of course, are the portions of slots 38 in flap 26 defining a substantial free length of springs 32 for the flexing thereof. The purpose of protrusions 42 and the mating pockets in member 24 is not only to provide or define a hinge area, but is further for the purpose of allowing the snapping together of the parts for ready replacement of flap 26 should replacement be required because of inadvertent damage to the assembly. In the preferred embodiment, the various parts of the present invention, other than springs 32, are fabricated of injection molded high impact resistant plastic, such as thereby providing sufficient resilience to allow the snapping together and taking apart of the invention, and to provide an anti dribble device which may not be easily damaged.

At the outer end of the inner diameter 30 of member 24 is a slight chamfered region 45, with a mating protrusion 47 on flap 26 fitting there against to provide improved sealing between the flap 26 and member 24. This provides a seal so as to resist the passage of air therebetween to displace the gasoline trapped in the nozzle, which otherwise may tend to cause the gasoline to run out. In this regard, if desired, member 26 may be made from a different plastic than member 24, in particular, a somewhat softer plastic so that member 24 defines a relatively hard and durable seat with the softer flap 26 having some compliance to better conform to the exact geometry of the seat.

Now referring to FIGS. 5, 6 and 7, the operation of the present invention may be seen. The anti dribble device 22 on nozzle 20 of the gas pump hand unit 46 generally extends into the fill pipe 48 of the gasoline tank 50 on the vehicle receiving gas. For this purpose, it will be noted that the outer diameter of member 24 is not much larger than the outer diameter of member 22, so as to freely pass within the fill pipe 48 on conventional vehicles, and further that flap 26 and the hinge and spring assembly therefore do not extend beyond the outer diameter of member 24. When the tank is being filled, the flap 26 moves to the open position shown in FIG. 5, with springs 32 being chosen so as to provide a sufficiently low encouragement of flap 26 toward the closed position to avoid the tripping of the automatic shut off mechanism in the handle 46. When flow is reduced by the hand unit 46, flap 26 starts moving toward the closed position, as shown in FIG. 6, and when finally the hand unit 46 is shut off, flap 26 moves to the completely closed position, as shown in FIG. 7. Throughout the figures, the tubular member 20 is completely full of gasoline established by the flow, as shown in FIG. 5, and retained by the gradual closure of member 26 from the position shown in FIG. 5 to the position shown in FIG. 6, maintaining sufficient pressure on the gasoline in member 20 to prevent air passing into member 20, and ultimately closing, as shown in FIG. 7 against the stationary column of gasoline in member 20.

It is a requirement that the present invention not interfere with the proper operation of the automatic shut off mechanism in the hand unit 46, and further that member 26 does not restrict the flow of gasoline in any substantial amount so as to possibly effect any other aspect of the standard gasoline delivery system, such as flow meters and the like. Of course with respect to the automatic shut off, the existence of flap 26, assuming the springs are of proper force, does not interfere with the automatic shut off, as gasoline backing up against the outside surface of member 26 will reflect the same pressure against the gasoline impinging on the inner surface thereof, thereby communicating the shut off pressure signal. Similarly, with respect to restriction of flow, it is to be noted that flap 26, being hinged right at the periphery of member 24 does not restrict the cross section of nozzle member 22 or member 24, so that the flap when in the open position, does not restrict the flow area. Of course, the springs encouraging the flap to the closed position do provide a force tending to slightly restrict the flow. Thus, for all of the reasons previously given, it is desirable to provide relatively low force springs for springs 32. However, there is an additional consideration which bounds the lower limit of the spring force. That consideration basically is the effect of gravity on the column of gasoline in the tubular member 20. Accordingly, while only a very low closure force is required for flap 26 when the assembly is held in the position shown in FIG. 7, the closure force requirement will be greater if the hand unit 46 is held with the anti dribble device in a vertical downward disposition, particularly if the seal between member 26 and member 24 is less than ideal, and at least small amounts of air can travel up tubular member 20 to displace the gasoline therein and allow the direct weight of gasoline to bear against the flap 26.

For at least some automatic shut off systems, the closure force required to resist the weight of a column of gasoline may exceed the flow restriction allowed without triggering the automatic shut off system, so that without some special provision, closure against gravity without interfering with automatic shut off is difficult or cannot be achieved. In this event, some form of latching system may be desired, such as by way of example, a latching system comprising a magnet 53 and iron piece 52, as shown in FIG. 2 to provide a latching or increased force just as the flap moves to the closed position. This latching force aids in the sealing of the end of member 24 by the flap 26 in the closed position, though presents negligible force when in the open position, and is readily encouraged to the open position by the surge in gasoline pressure upon turning on the hand unit 46. Of course, other latching devices may also be used, and if desired, a plurality of such latching devices may be used, such as by way of example, in diametrically opposed positions with springs 32 floating in openings 34 in member 24 and with some freedom in the pivots 42 so that the latching device provides a longitudinal force on the flap 26 to hold the flap firmly against the seat in member 24.

It is preferred that the force of the springs tending to close the flap does not change substantially from the nearly closed position to the fully open position. This requires that the springs 32 have a very substantial preload even when in the closed position, which may be achieved by providing the springs 32 with a relaxed state form shown in FIG. 2*a*. However, in order to further provide for preload of the springs and to assure that the elastic limit of the spring material is not exceeded, the alternate embodiment of FIG. 4 may be used. This figure shows a cross section of the alternate embodiment similar to the cross section of FIG. 3, with the remainder of the design of a flap and member 24 remaining the same. In this embodiment, the springs 32*a* shown in profile in the relaxed state in FIG. 4*a*, have one or more coils 60 in the region of the 90° bend. The flap in the region colinear with the pivots 42 has a pair of inward protruding cylindrical members 62 of reduced diameters with a separation 64 therebetween to allow the mounting of the springs onto the flap after fabrication of the individual springs. The coils 60 of course provide for greater deflection of the spring from the relaxed state without exceeding the elastic limit thereof, allowing the use of a more highly preloaded (and smaller) springs to provide a more constant and lower closing force. Of course if a latching system is used as hereinbefore described, the spring need only have sufficient force to bring the flap back to the closed position as the flow reduces to zero.

There has been described herein an anti dribble nozzle for fuel pumps to eliminate the dripping and spillage previously encountered upon withdrawal of the nozzle from a vehicle gas tank, which spillage is wasteful, tends to deteriorate the vehicle finish and releases pollutants to the atmosphere. The present invention does not interfere with the normal metering and automatic shut off features found on prior art fuel pumping equipment, as the restriction of flow is maintained at a very low level and the tubular member on the nozzle is always maintained in the full state, both before and after a delivery. Specifically described herein are certain specific embodiments of the present invention. However it is to be noted that while the invention has been specifically disclosed and described with respect to these embodiments it will be obvious to those skilled in the art that various changes in form and detail may be made therein without departing from the spirit and scope of the invention.

I claim:

1. A fuel pump nozzle anti dribble device comprising:

an approximately tubular body member having first and second ends and defining a fuel flow path therethrough, said body member having a means adjacent said first end for pressing over the end of a nozzle, said body member further having a valve seat means adjacent its said second end;

a flap like valve closure member supported by said body member for rotation about an axis adjacent the periphery of said closure member and generally perpendicular to said fuel flow path, said closure member having a surface for engaging said valve seat means on said body member when said closure member is in a closed position to restrain the flow of fuel through said body member;

one of said closure member and said body member having adjacent its periphery a pair of oppositely facing surfaces each having a depression therein, said depressions falling on an axis of said device generally perpendicular to and radially displaced from the axis of said fuel flow path, the other of said body and said closure member extending adjacent said two surfaces for fitting within said depressions, whereby said closure member and said body member may snap together; and at least one spring disposed between said body member and said closure member to yieldably encourage said closure member to said closed position, said at least one spring being a wire spring member having one end extending into a cooperatively disposed longitudinal hole in said body member and having the other end extending into a cooperatively disposed hole in said closure member extending generally perpendicular to the axis of rotation of said closure member.

2. The fuel pump nozzle anti dribble device of claim 1 wherein said body member and said closure member are injection molded plastic members.

3. The fuel pump nozzle anti dribble device of claim 1 wherein the inner diameter of said body member is approximately equal to the inner diameter of the nozzle on which it mounts and the axis of rotation of said closure member falls outside the periphery of said inner diameter.

4. The anti dribble device of claim 1 wherein the portion of the axis of rotation of said closure member between said depressions is located within the outer diameter of said body member.

5. The anti dribble device of claim 2 wherein said axis of rotation of said closure member is located beyond the inner diameter of said body member.

6. An anti dribble device comprising:

an approximately tubular body member defining a flow path therethrough and having a valve seat means adjacent one end thereof;

a flap like valve closure member supported by said body member for rotation about an axis adjacent the periphery of said closure member and generally perpendicular to said flow path, said closure member having a surface for engaging said valve seat means on said body member when said closure member is in a closed position to restrain the flow through said body member;

one of said closure member and said body member having adjacent its periphery a pair of oppositely facing surfaces each having a depression therein, said depressions falling on an axis of said device generally perpendicular to and radially displaced from the axis of said flow path, the other of said body and said closure member extending adjacent said two surfaces for fitting within said depressions, whereby said closure member and said body member may snap together; and at least one spring disposed between said body member and said closure member to yieldably encourage said closure member to said closed position, said at least one spring being a wire spring member having one end extending into a cooperatively disposed opening in said body member and having the other end extending into a cooperatively disposed opening in said closure member extending generally perpendicular to the axis of rotation of said closure member.

7. The anti dribble device of claim 4 wherein the portion of the axis of rotation of said closure member between said depressions is located within the outer diameter of said body member.

8. The anti dribble device of claim 5 wherein said axis of rotation of said closure member is located beyond the inner diameter of said body member.

9. The anti dribble device of claim 4 wherein said closure member includes means for retaining said spring adjacent said axis of rotation.

* * * * *